United States Patent [19]

De Nora et al.

[11] 3,930,980

[45] Jan. 6, 1976

[54] ELECTROLYSIS CELL

[75] Inventors: Oronzio De Nora, Milan, Italy; Vittorio De Nora, Nassau, Bahamas

[73] Assignee: Oronzio De Nora Impianti Elettrochimici S.p.A., Milan, Italy

[22] Filed: June 30, 1970

[21] Appl. No.: 51,162

[52] U.S. Cl. ..... 204/256; 204/266; 204/268; 204/270; 204/275; 204/278; 204/286

[51] Int. Cl.[2] ..... C25B 13/00

[58] Field of Search ..... 204/128, 255, 256, 263, 204/266, 270, 278, 253, 268, 275, 286

[56] References Cited

UNITED STATES PATENTS

| | | | |
|---|---|---|---|
| 563,972 | 7/1896 | Kroseberg et al. | 204/262 |
| 1,620,052 | 3/1927 | Allan | 204/266 |
| 1,790,248 | 1/1931 | Roth | 204/268 |
| 1,815,078 | 7/1931 | Smith | 204/253 |
| 2,739,936 | 3/1956 | Zdansky | 204/278 |
| 3,236,760 | 2/1966 | Messner | 204/256 |
| 3,536,598 | 10/1970 | Yanagase et al. | 204/128 |
| 3,563,878 | 2/1971 | Grotheer | 204/256 |

FOREIGN PATENTS OR APPLICATIONS

| | | | |
|---|---|---|---|
| 1,127,484 | 9/1968 | United Kingdom | 204/266 |

*Primary Examiner*—John H. Mack
*Assistant Examiner*—W. I. Solomon

[57] ABSTRACT

Describes an electrolysis cell having metal anodes (preferably titanium) and metal cathodes connected together, back to back, by a metal to metal contact forming a bimetallic partition. The anodes and cathodes are in wave form with their active surfaces intermeshed together and the cell may be unipolar or bipolar with terminal positive and negative end unit cells and a plurality of intermediate cell units.

22 Claims, 11 Drawing Figures

INVENTORS
ORONZIO de NORA
VITTORIO de NORA
BY
ATTORNEYS

INVENTORS
ORONZIO de NORA
BY VITTORIO de NORA

ATTORNEYS

INVENTORS
ORONZIO de NORA
BY VITTORIO de NORA

ATTORNEYS

INVENTORS
ORONZIO de NORA
BY VITTORIO de NORA

ATTORNEYS

INVENTORS
ORONZIO de NORA
VITTORIO de NORA
BY

ATTORNEYS

INVENTORS
ORONZIO de NORA
BY VITTORIO de NORA
ATTORNEYS

INVENTORS
ORONZIO de NORA
BY VITTORIO de NORA
ATTORNEYS

INVENTORS
ORONZIO de NORA
BY VITTORIO de NORA

ATTORNEYS

INVENTORS
ORONZIO de NORA
BY VITTORIO de NORA

ATTORNEYS

ELECTROLYSIS CELL

This invention relates to electrodes, namely, cathodes and anodes, for use in diaphragm electrolysis cells and to the electrolysis cell made by the use of these electrodes. The electrodes may be either unipolar or bipolar, but to better illustrate the advantages of this invention, the use of bipolar electrodes in the production of chlorine and caustic soda will be described in the principal embodiment of the invention illustrated and described below.

Electrolysis cells built according to the teachings of this invention may be used for the electrolysis of sodium or potassium chloride to produce chlorine and caustic soda or caustic potash, for the production of chlorates or perchlorates, for the electrolysis of hydrochloric acid, to produce hydrogen and chlorine, for the electrolysis of water to produce hydrogen and oxygen, for the electrolysis of sodium and potassium sulfate to produce caustic soda or caustic potash and sulphuric acid, for electro-osmosis and electrodialysis, for organic oxidation and reduction reactions, for electrometallurgical uses and for other processes which may be carried out by electrolysis reactions.

One of the objects of this invention is to provide new types of electrodes and electrolysis cells in which anodic and cathodic reactions may be carried out more efficiently than in prior electrolysis cells.

Another object of this invention is to provide new types of unipolar and bipolar electrolysis cells which are easier and cheaper to construct and operate than prior electrolysis cells.

Another object of this invention is to provide a metal to metal bimetallic connection between the anodes and the cathodes of a bipolar electrolysis cell.

Various other objects and advantages of this invention will appear as this description proceeds.

Referring now to the drawings, which show various concrete and diagrammatic embodiments of the invention for the purpose of illustration:

In bipolar diaphragm cells used in the past for the electrolysis of brine, the diaphragm covered steel screen cathode fingers have been used with graphite anode plates in the places between the cathode fingers.

As illustrated, for example, in U.S. Pat. No. 3,337,443, the electrical connection between the steel screen cathode fingers and the graphite anode set of the next bipolar element was normally a complicated system of graphite and steel bolts with springs to hold the connections together. This presented a bulky construction with complicated maintenance problems, and the bipolar graphite anode and steel cathode cells of the prior art usually had a useful life of only 6 to 8 months before rebuilding was necessary. In the bipolar cells of this invention, both the anodes and the cathodes are constructed of metal and there is a metal to metal connection between the electrodes and a metal to metal path for the flow of current through the cell.

Figure 1:
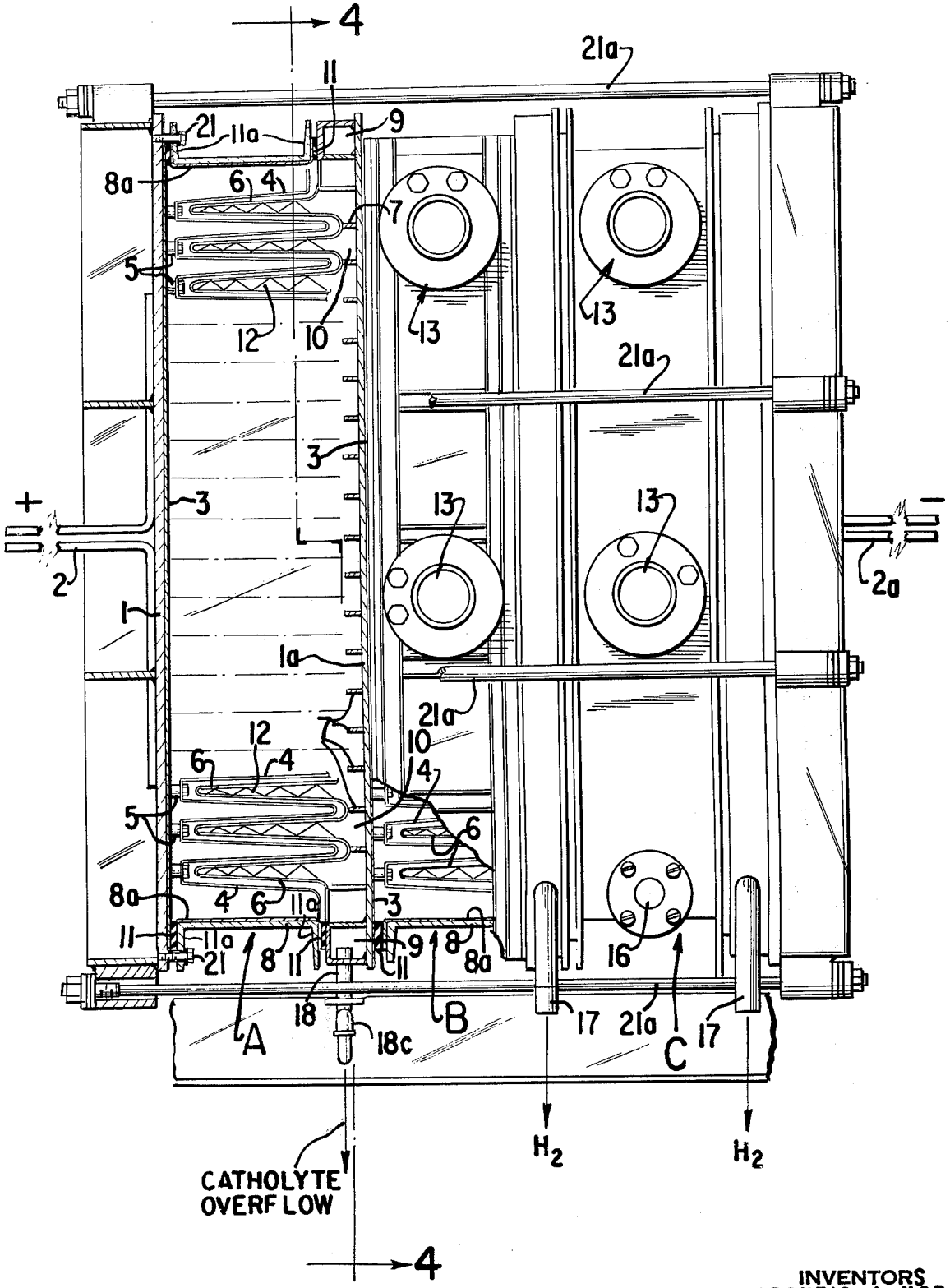
FIG. 1 is a plan view with parts broken away, of a three unit bipolar cell constructed according to the principles of this invention.

Referring now to the embodiments of this invention illustrated in FIGS. 1 to 6 of the drawings, FIG. 1 illustrates a three unit bipolar cell having a terminal positive end unit A, an intermediate unit B and a terminal negative end unit C. Only one intermediate unit B has been illustrated, but it will be understood that any number of intermediate units B, B, etc. may be used. The unit A consists of a positive (anode) end plate 1, preferably of steel, to which the positive electrical connections 2 are secured. The plate 1 is provided with a titanium, tantalum or other valve metal lining 3 which is resistant to the electrolyte and the electrolysis conditions encountered in the cell and the anode waves or fingers 4 are connected to the titanium lining by titanium connectors 5, illustrated in greater detail in FIGS. 5 and 6 and described in detail below, which space the anodes from the lining 3 and insure good electrical connections between the end plate 1 and the anode waves or fingers 4. The interior of the anode waves are hollow as illustrated in FIGS. 1, 5, 6 and 7. The titanium or other valve metal lining 3 is secured to the end plate 1 by sandwich welding, using intermediate sandwich metals if necessary, or by bolting or any other connection which insures a good metal to metal electrical contact between the end plates 1 and the electrolyte resistant lining 3. Titanium, tantalum or other valve metals or alloys of these metals may be used for the lining 3 and the anode waves or fingers 4.

Figure 4:
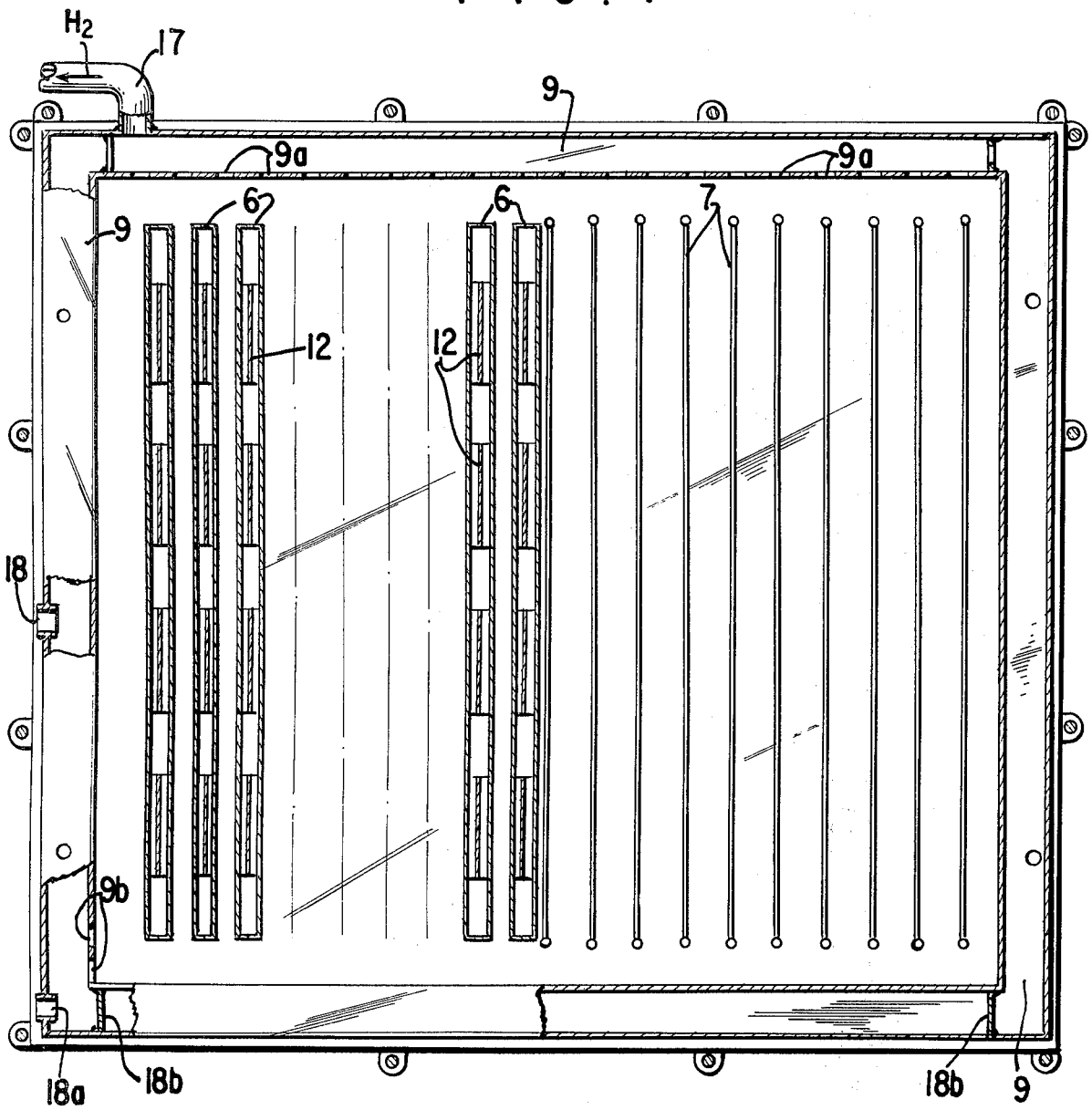
FIG. 4 is a cross sectional view, approximately on the line 4 — 4 of FIG. 1.

The end anode plate 1 is spaced from a steel cathode supporting end plate 1*a*, from which the steel screen cathode waves or fingers are supported by welding strips or projections 7 which space the cathode from end plates 1*a* and form the electrical connection between the cathode fingers and the steel plate 1*a*. A rectangular spacer frame 8 forming the side walls of each cell unit, extends between the lining 3 and a squared pipe 9 which surrounds the catholyte compartment 10 formed between the inside of the cathode fingers 6 and the plate 1*a*. The spacers are lined with a titanium lining 8*a* or with a polyester or other lining which is resistant to the anolyte and the corrosive conditions encountered in an electrolytic cell. The rectangular spacer frames 8 are provided with outwardly extending flanges 11*a* which form the joints between the spacers 8 and the end plates 1, 1*a*, etc. and rubber gaskets 11 seal the joints between the plates 1 and 1*a* and the spacers 8 so that a fluid-tight box-like structure housing the anode waves 4 and the cathode waves 6 is formed between the plates 1 and 1*a* in each of units A, B and C of the bipolar cell. Inside each cathode finger 6, zigzag bent steel reinforcements 12 are welded at spaced intervals inside the cathode fingers to prevent collapse of the screen cathode waves or fingers 6 when an asbestos or other diaphragm material is deposited on the screen cathode fingers under vacuum. The steel screen cathode waves or fingers 6 are closed at the top and bottom as illustrated in FIG. 4 and are covered with a diaphragm material 6*a* (FIGS. 5 and 6), usually either woven asbestos fiber or asbestos flock applied under vacuum. The diaphragm material covers the side walls as well as the top and bottom of cathode waves or fingers 6. The diaphragms are only partially and diagrammatically shown in FIGS. 5 and 6, but it will be understood that the cathode waves 6 are completely covered with diaphragms in the cells. The diaphragms separate the anolyte compartment from the catholyte compartment and keep the gases formed in each of these compartments separate as is well understood in the diaphragm cell art. In the case of chlorine and caustic production from a sodium chlorine brine, the diaphragms keep the chlorine released at the anode from mixing with the sodium hydroxide and hydrogen formed at the cathode.

Figure 2:
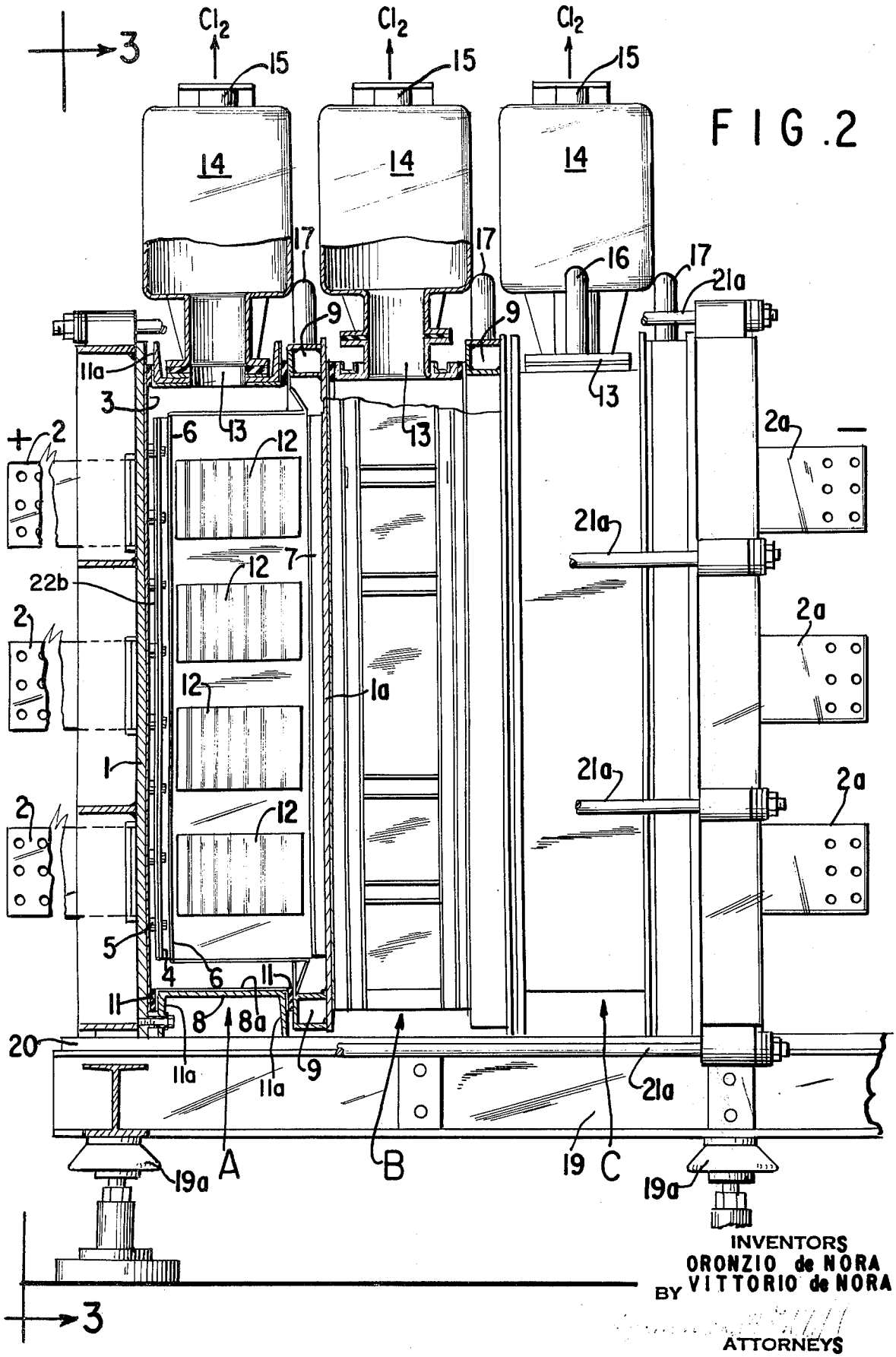
FIG. 2 is a part sectional side view, with parts broken away, of the cell illustrated in FIG. 1.
Figure 3:
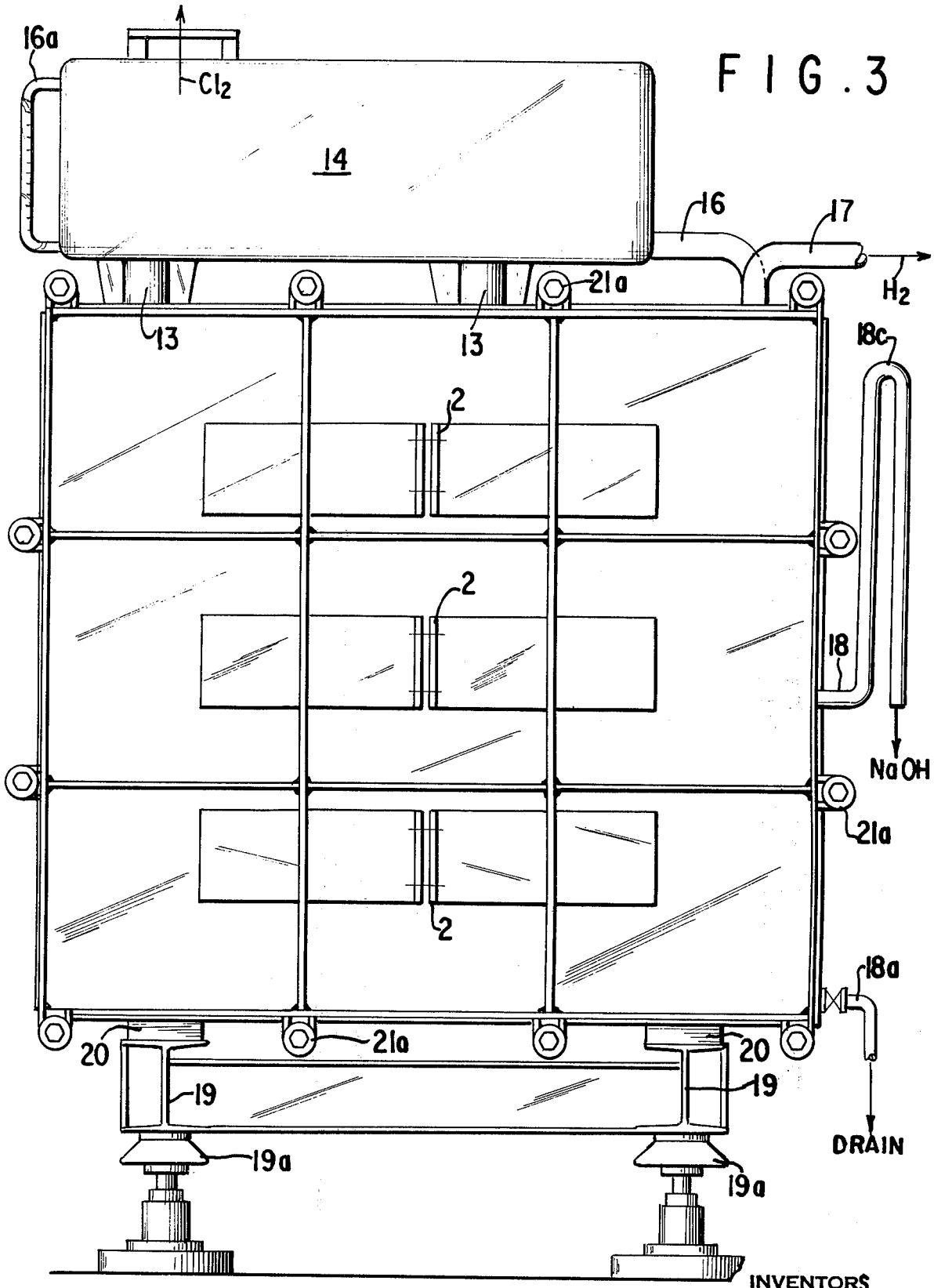
FIG. 3 is a partial front view of the three unit bipolar cell illustrated in FIGS. 1 and 2.

When the cell illustrated in FIGS. 1 to 3 is used for the electrolysis of sodium chloride brine to produce chlorine, caustic soda and hydrogen, the electrolyzing current flows from the anode waves 4 to the cathode waves 6. Chlorine is released at the anode waves or fingers, the brine flows through the diaphragms surrounding the cathode waves 6 and caustic soda and hydrogen are formed at the cathode surfaces inside the diaphragms.

Chlorine (or other anodic gases) released at the anodes 4 rises along both the front and the back of the anodes 4 through the electrolyte and escapes through the chlorine passages 13 into brine containers 14 on the top of each cell unit A, B, C and flows out of the chlorine outlets 15 to the chlorine recovery system. A pipe connection 16 feeds brine from each of the brine containers 14 (FIG. 2) to the spaces between the anode and cathode fingers of the cell units A, B and C and a sight glass 16*a* (FIG. 3) indicates the level of the brine in the brine containers 14.

Sodium hydroxide and hydrogen released at the cathode fingers flows into the catholyte space between diaphragms surrounding the cathode fingers 6 and the end plates 1*a* and into a squared pipe 9 (FIG. 4) which surrounds the catholyte space. The hydrogen flows upward through the holes 9*a* at the top of the squared pipe 9 and out through the hydrogen outlets 17 and the depleted brine containing the sodium hydroxide (about 11 – 12%) flows through the holes 9*b* to the catholyte outlet 18. An electrolyte drain 18*a* near the bottom of the square pipe 9 permits the catholyte compartment, as well as the anolyte compartment, of each cell unit to be drained. Partitions 18*b* at each end of the bottom leg of squared pipe 9 seal off the bottom leg so that no electrolyte enters the bottom leg of squared pipe 9. A gooseneck connection 18*c* (FIG. 3) communicating with the catholyte outlet 18 is adjustable to control the level of the catholyte in the catholyte compartment, preferably by pivoting the gooseneck 18*c* around the outlet 18 so that the catholyte level is always sufficiently below the anolyte level to insure a sufficient flow from the anolyte compartments through the diaphragms into the catholyte compartments.

Figure 5:
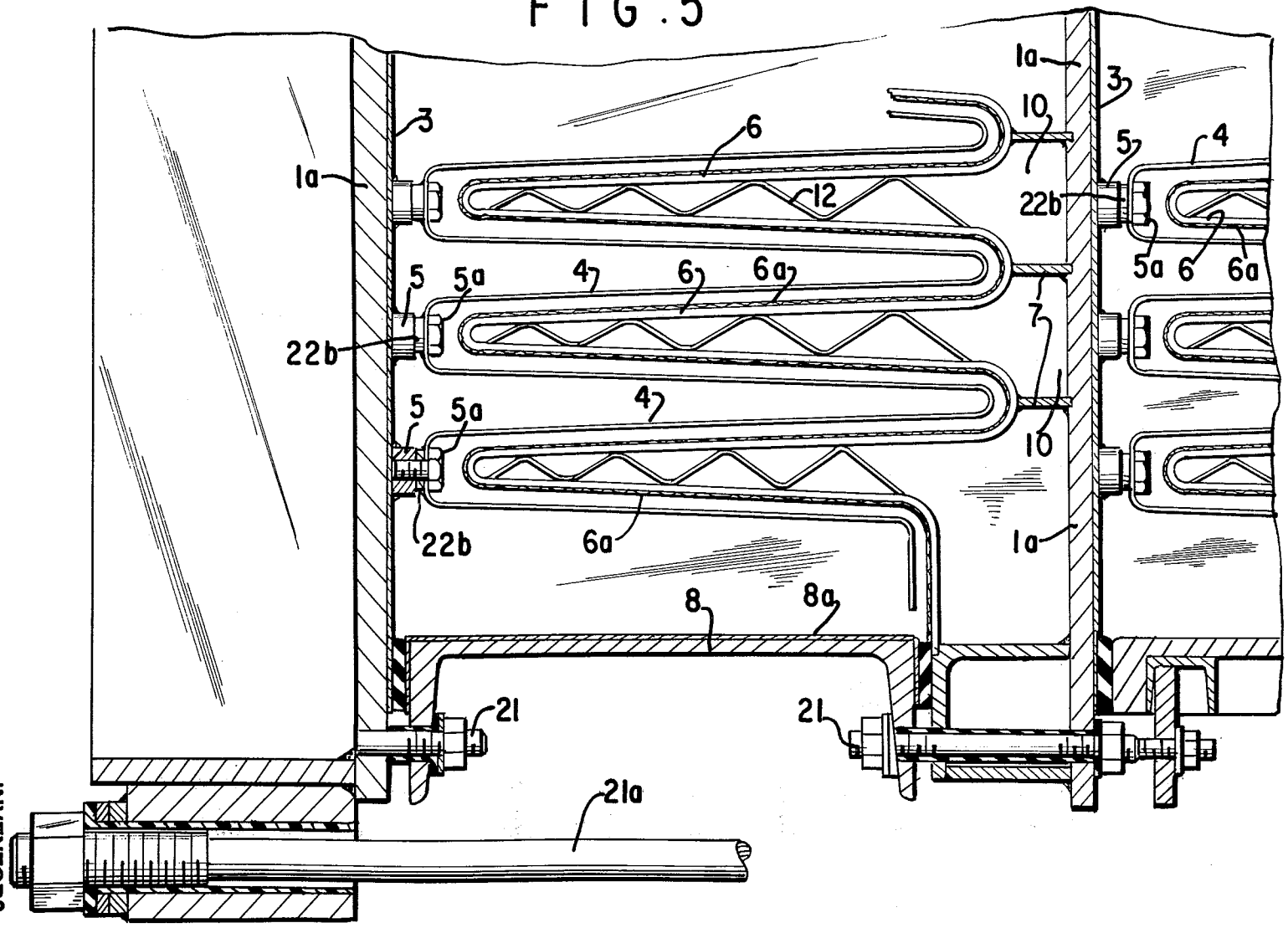
FIGS. 5 and 6 are detail cross sectional plan views of the anode-cathode connections in a bipolar cell.

The cell units A, B, B, B and C are mounted on I-beam supports 19 (FIG. 3), supported on insulators 19*a*. Syenite plates 20 cemented to the upper faces of the I-beams 19 insulate the titanium lined boxes of the cell units A, B and C from the metal I-beams and permit the heavy elements of the cell units to slide on the syenite plates 20 without too great friction during assembly or disassembly of the units. The sides of spacers 8 and the ends 1 and 1*a* are held together by tie rods 21*a*, suitably insulated from their surrounding parts by means of insulating bushings, as shown in FIGS. 1 and 5. The temporary bolts 21 shown in FIGS. 1 and 5, are used only during assembly of the electrolyzer, to tighten the units together at the flanges 11*a* and are taken off before start up of the cell in order to avoid short circuits. During operation of the cell, the tie rods 21*a*, suitable insulated from their surrounding parts, hold the terminal end plates 1 and 1*a* and the rectangular side spacers 8, forming the electrolyte box of each cell unit, together. The tie rods 21*a* extend from the positive terminal end plate 1 of unit A to the negative terminal end plate 1*a* of the terminal unit C regardless of the number of intermediate units B in the bipolar cell assembly.

The electrolyzing current flows consecutively from the positive terminal 2 through the end unit A, through the intermediate units B, which vary in number from one to twenty or more, depending on the size and use of the bipolar cell, and through the terminal unit C to the negative terminal 2*a* of the circuit. The anode waves or fingers 4 are preferably made of titanium mesh, suitably coated with an electrocatalytic conductive coating such as a platinum group metal or mixed oxides of titanium and platinum group metal oxides. Other valve metals and other coatings may be used. The cathode waves or fingers 6 are preferably steel screen material or other ferrous metal similar to the cathode screens now used in diaphragm cells. However, other metals may be used for the anode and cathode waves depending on the material to be electrolyzed and the end products to be produced.

Figure 6:
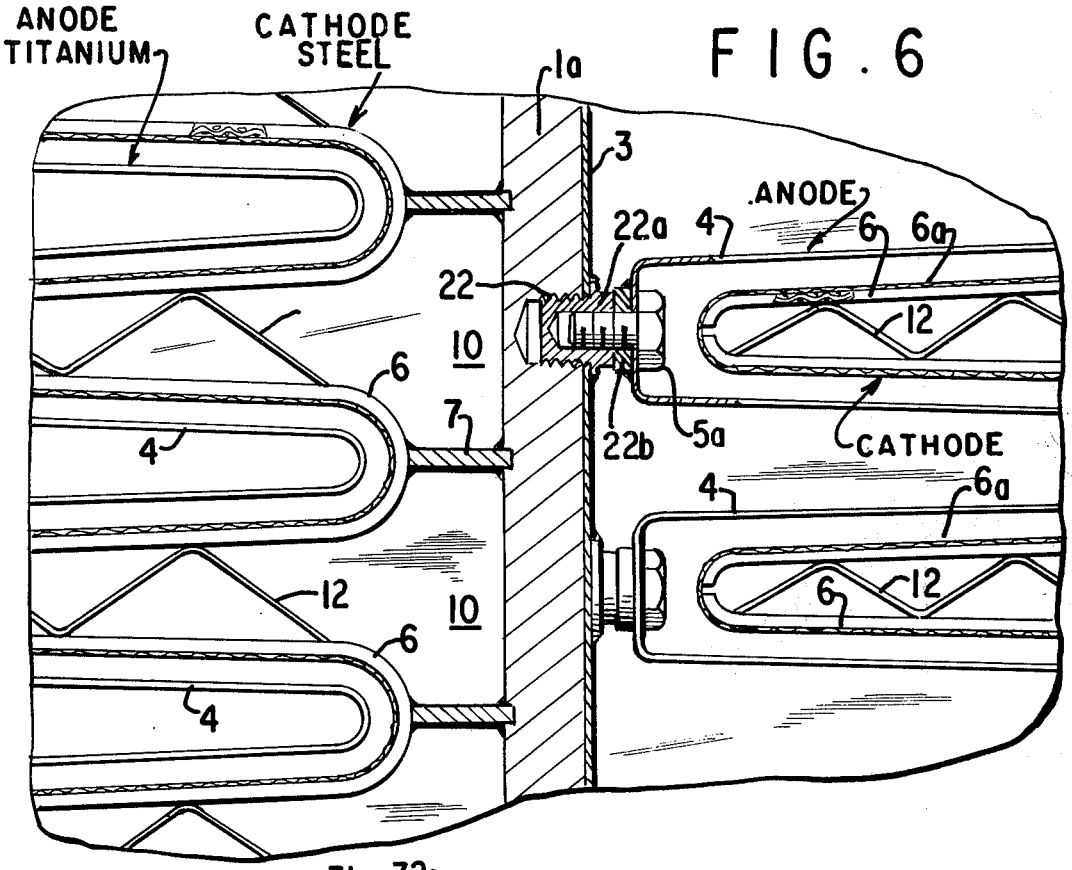

The anodes 4 and cathodes 6 are preferably formed as uniform waves or fingers nested together and uniformly spaced apart, as illustrated in FIGS. 1, 5 and 6, to provide a substantially uniform electrode gap between the anodic surfaces and the cathodic surfaces. The anode waves 4 and cathode waves 6 may be moved together by moving the plates 1 and 1*a* with the anodes and cathodes mounted thereon horizontally toward each other, to form the nesting anode and cathode waves as illustrated in FIGS. 1, 2, 5 and 6, or, by giving a slight taper in the vertical direction to the anode and cathode waves, the anodes and cathodes may be nested together by vertically inserting the cathode waves between the anode waves. The anode waves 4 and cathode waves 6 need not be long or deep as illustrated. Shallower waves may be used, but the deeper waves illustrated provide greater anode and cathode surfaces within cell units of the same square area than shallower waves would provide.

Figure 8:
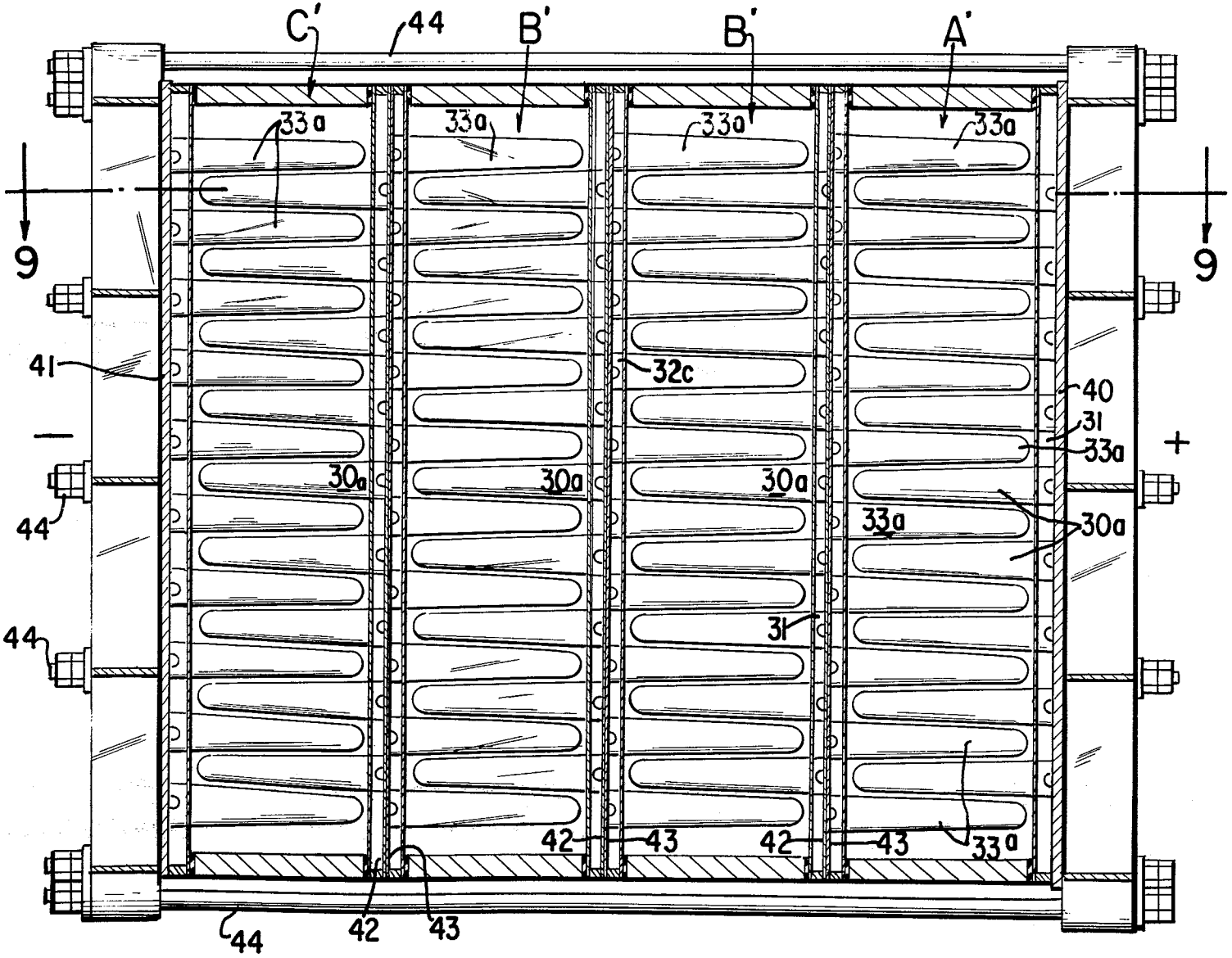
FIG. 8 is a cross sectional view of another embodiment of this invention, along the line 8 — 8 of FIG. 9.
Figure 9:
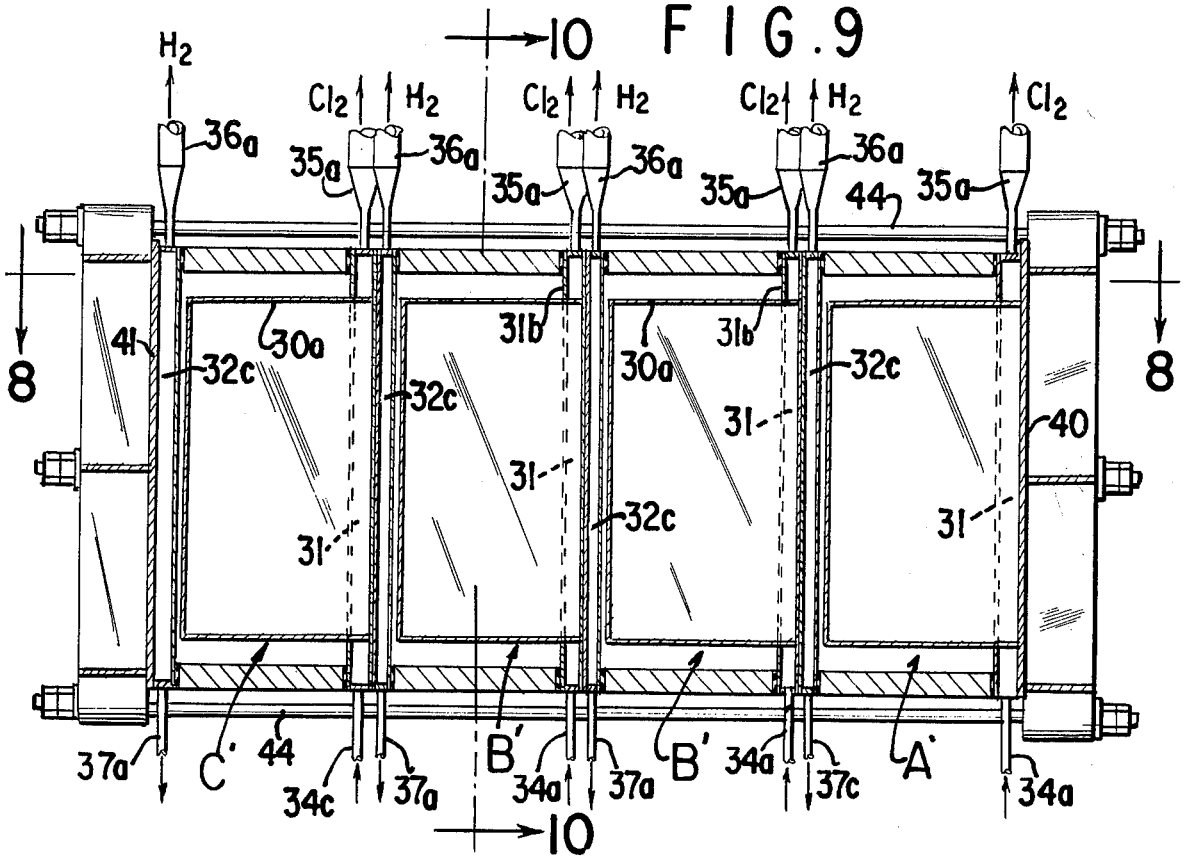
FIG. 9 is a diagrammatic sectional view along the line 9 — 9 of FIG. 8.
Figure 10:
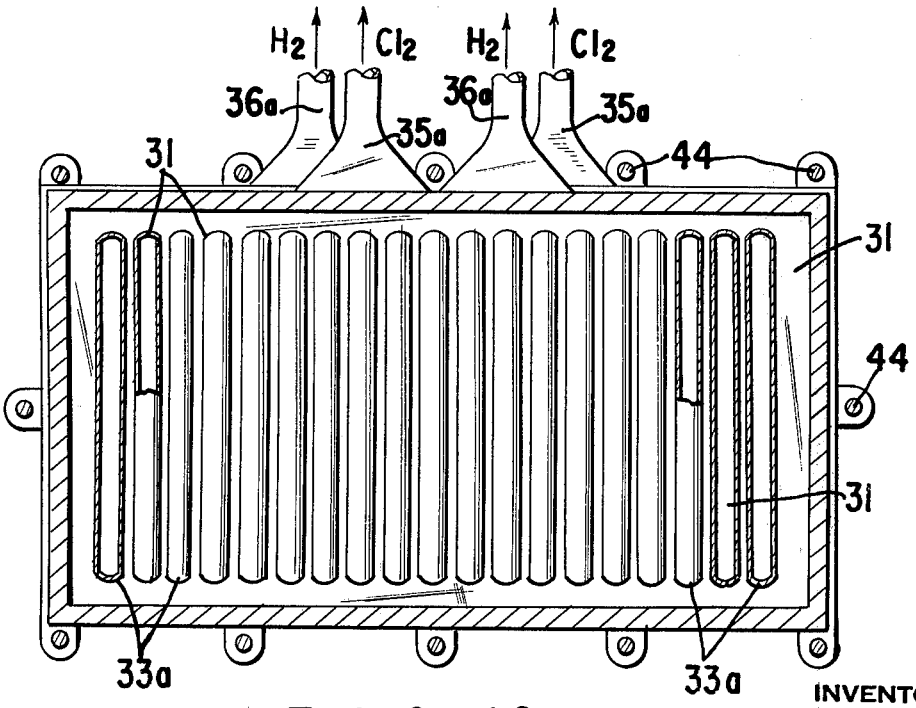
FIG. 10 is a sectional view approximately along the line 10 — 10 of FIG. 9.

The words "waves" or "fingers" wherever used in the specification or claims are intended to describe the wave embodiments of FIGS. 1 to 6 or the finger embodiments of FIGS. 8 to 10.

To insure good electrical connection between the anodic and the cathodic sections of the cell, the anodic metals, such as titanium, tantalum and other valve metals, are preferably sandwich welded to the steel plates 1 and 1*a* constituting the anodic and cathodic pole of any single cell unit, using appropriate intermediate metals, such as copper, lead, etc., to form the sandwich weld, if necessary. Other means which will provide good electrical connections may be used. The valve metal anodic plates 3 and the steel cathodic plates 1*a* form bimetallic partitions between the cell units A-B-B-B and C.

As illustrated in FIG. 5, the anode waves 4 are connected to and spaced from the titanium lining plate 3 by titanium or other cylinders 5 welded to the plate 3. The cylinders 5 are screw threaded on the inside and titanium bolts 5*a* are used to connect the anode waves 4 to the cylinders 5 and plate 3, using titanium strips 22*b*, where the titanium anodes are welded on. The steel cathode waves 6 are connected to the plates 1*a* by steel strips 7 welded to the plates 1*a* and to the trough or base of the waves 6. The cathode waves are entirely covered with a diaphragm material, such as woven asbestos, asbestos fibers or the like, partially illustrated at 6*a* in FIGS. 5 and 6. A modified form of connection between the steel plates 1*a* and the anode waves is illustrated in FIG. 6, in which holes 22 are drilled part way through plates 1*a* and screw threaded. Hollow titanium bolts 22*a* are screwed into these holes and, after tightening, are welded to the titanium plate 3 to insure a fluid tight connection, and titanium bolts 5*a* used to connect the titanium strips 22*b* with the trough of anode waves 4 and with the hollow titanium bolts 22*a*. Titanium strips 22*b* distribute the current to the anode waves 4. The titanium anode waves 4 may be solid titanium sheet, perforated titanium sheet, slitted, reticulated titanium plates, titanium mesh, rolled titanium mesh, woven titanium wire or screen, titanium rods or bars all of which will be referred to as "open mesh" construction or similar tantalum and other valve metal plates and shapes or alloys of titanium or other valve metals, or any other conductive form of titanium and the waves 4 are provided with a conductive electrocatalytic coating capable of preventing the titanium from becoming passivated, and when used for chlorine production are capable of catalyzing discharge of chloride ions from the surfaces of the anodes. The coating may be on either one or both faces of the anode waves and is preferably on the face of the anode waves 4 facing the cathodes 6.

Figure 11:
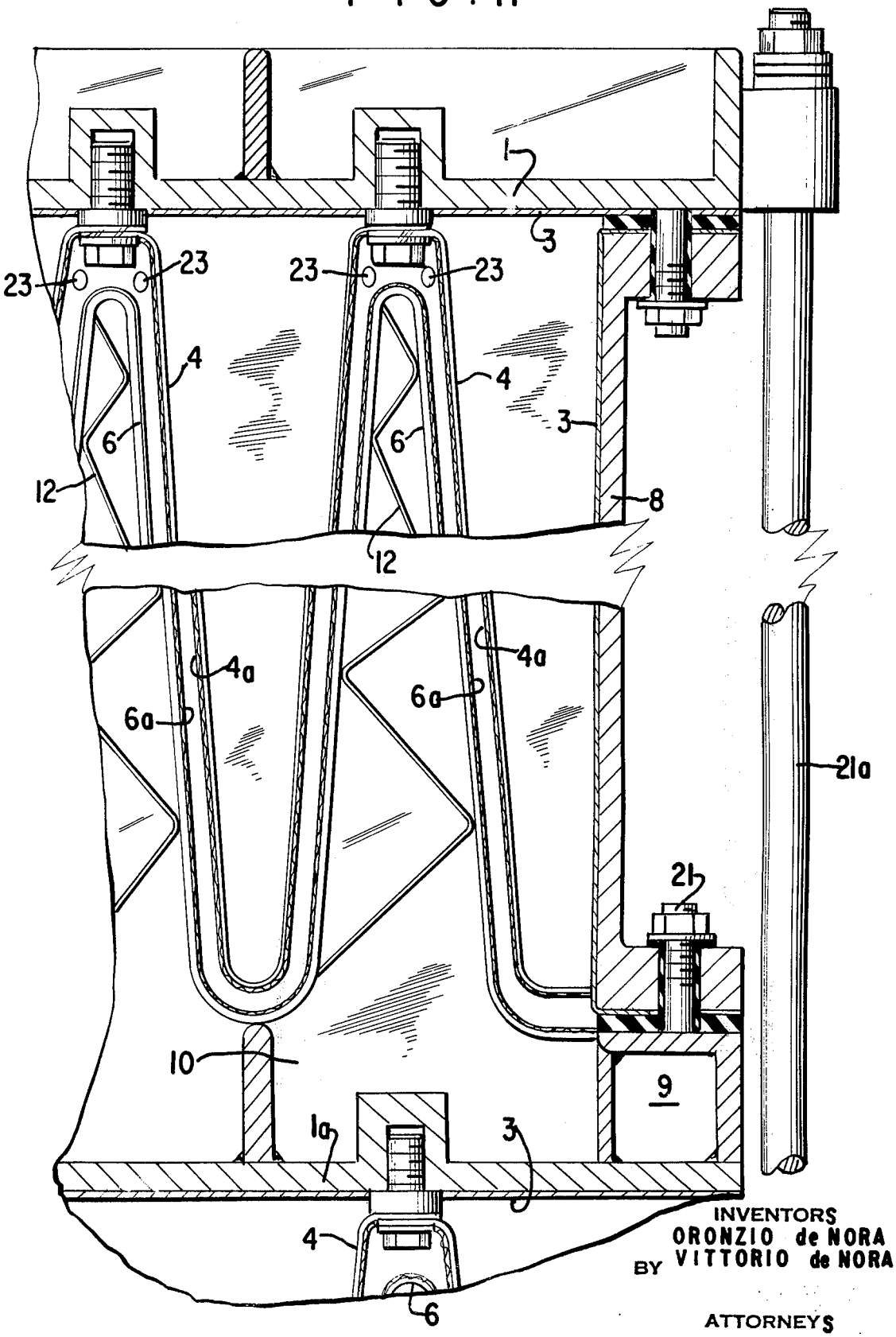
FIG. 11 is a plan view showing the use of diaphragms on both the anode and cathode fingers with the electrolyte being fed into the cell between the two diaphragms.

Diaphragms may be provided on the anode waves 4 or the cathode waves 6 or on both the anode waves and cathode waves as illustrated in FIG. 11, and the anolyte liquor and catholyte liquor kept separate by cell liquor between the diaphragms. The cell liquor undergoing electrolysis may be flowed into the space between the anode diaphragms and the cathode disphragms and the anolyte liquor and gaseous anode products flowed out from the inside of the anode fingers or waves as the gaseous and liquid cathode products are flowed out from the inside of the cathode fingers in the embodiments of FIGS. 1 to 6 described above and more complately shown and described in connection with FIG. 11.

Figure 7:
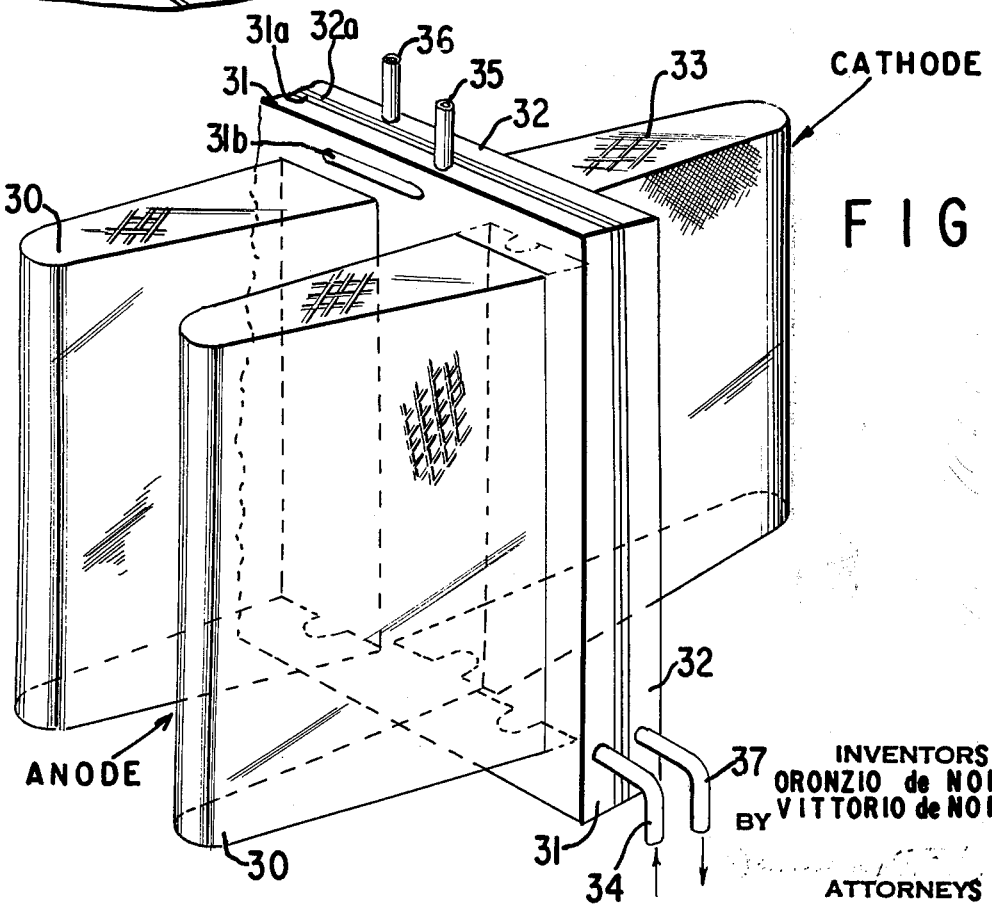
FIG. 7 is a diagrammatic perspective view of a portion of a bipolar anode and cathode showing the connection therebetween.

FIGS. 7 to 10 are diagrammatic embodiments, illustrating, in principle, various forms of this invention. In the diagrammatic illustration of FIG. 7, the perforated or reticulated titanium anode waves or fingers 30 are mounted in the front of a titanium hollow box 31 with which the hollow insides of the fingers 30 communicate. The back of the box 31 is a sheet of titanium 31*a* which is welded, bolted or otherwise secured to the back 32*a* of steel box 32 to which the screen cathode fingers 33 are secured. The interior of the cathode fingers communicate with the interior of steel box 32 and the exterior of the cathode fingers are covered with diaphragm material. While only two anode fingers 30 and one cathode finger 33 are shown in FIG. 7, it will be understood that a plurality of anode and cathode fingers are used and that these fingers mesh as illustrated in FIG. 8. In a complete cell according to FIG. 7, the anode and cathode fingers are meshed together as illustrated in FIGS. 1, 6 or 8 to form intermediate cell units and terminal positive and negative end plates are provided to form a bipolar cell containing the anode and cathode sets illustrated in FIG. 7.

Brine enters the box 31 at the brine inlet 34 and flows out through the hollow anode fingers 30 toward the nested cathode fingers 33 (not shown), facing the anode fingers 30 at the left side of FIG. 7. Chlorine formed at the anodes flows out box 31 at the chlorine outlet 35. The front or anode finger face of box 31 is provided with slots or openings 31*b* through which chlorine gas may flow into the box 31 as well as from the inside of the anode fingers 30. Hydrogen released inside the diaphragms at the cathode fingers 33 flows out of outlet 36 and sodium hydroxide (11 – 125) and brine flow from the outlet 37.

In the diagrammatic embodiments of FIGS. 8, 9 and 10, the current flows from right to left in FIG. 8. The anode fingers 30*a* and the cathode fingers 33*a* fit between each other as illustrated in FIG. 8, to form the cell units A′, B′, B′ and C′ and positive and negative end plates 40 and 41 form the terminal connections for the bipolar cell. The end plate 40 and the sides of the box-like structure formed by units A′, B′, B′ and C′ are lined with titanium or other material which is resistant to the corrosive conditions encountered in a chlorine cell. Various valve metals may be used for this purpose, and glass fiber polyester or hard rubber lining may be used in those areas where no current is to be conducted. Intermediate titanium and steel plates 42 and 43 welded back to back separate the cell units A′, B′, B′ and C′ and provide supports, respectively, for the anode fingers 30*a* and cathode fingers 33*a*. Brine enters the titanium boxes 31, supporting the anode fingers 30*a*, at the brine inlets 34*a* and flows toward the diaphragm covered cathode fingers 33*a*. Chlorine is discharged through the chlorine outlets 35*a*, hydrogen is discharged from the steel boxes 32*c* through the hydrogen outlets 36*a* and sodium hydroxide and depleted brine is discharged through the outlets 37*a*. The long bolts 44 which hold the units A′, B′, B′ and C′ together are suitably insulated from the end plates 40 and 41 to prevent short circuits around the cell units.

FIG. 11 shows an embodiment of the invention in which both the mesh anode fingers 4 and steel cathode fingers 6 are provided with diaphragms 4*a* and 6*a* and in which the fresh electrolyte enters the cell through passages 23 and flows through the diaphragms covering both the anode fingers 4 and the cathode fingers 6. The cell box walls 1, 1*a*, 8, etc. are lined with titanium sheets 3 or other suitable corrosion resistant lining as described in the previous embodiments. When an electrolyzing current is passed through the electrolyte between the anodes and the cathodes, the anodic products are released at the anodes and the cathodic products at the cathodes. The anodic and cathodic products are kept separate by the two diaphragms 4*a* and 6*a* and by the body of electrolyte between the two diapharagms. This embodiment is particularly useful for the electrolysis of sodium or potassium sulfate solutions to produce sodium or potassium hydroxide and sulfuric acid. It may, however, be used for other electrolysis processes.

The concrete and diagrammatic embodiments of the invention shown herein are for illustrative purposes only and various modifications and changes may be made within the spirit and objects of the invention. The cells illustrated may be used as unipolar single cells or as bipolar multiple cells and while titanium and steel have been described as the metals of construction, various dissimilar metals may be used for the anodes and cathodes of the cell units. Examples of other suitable anode metals are lead, silver and alloys thereof and metals which contain or are coated with $PbO_2$, $MnO_2$, $Fe_3O_4$ etc. and examples of other suitable cathode metals are copper, silver, stainless steel, etc. The metals used should be suitable to resist the corrosive or other conditions encountered in the cell when operating on a particular electrolyte. While diaphragms on the cathodes, the anodes or both will usually be used, the cells can be used without diaphragms for certain purposes, such as chlorate, perchlorate, hypochlorite, periodate production and for other electrolysis processes in which diaphragm separation of the electrolysis products is not necessary.

What is claimed is:

1. In an electrolysis cell, a plurality of cell units, a rectangular frame around each cell unit, an anode compartment and a cathode compartment in each cell unit, said anode compartments and cathode compartments being separated from the anode and cathode compartments of the adjacent cell units by a continuous separating partition of a ferrous metal on the cathode side and a valve metal on the anode side, said frames and the anode and cathode compartments therein being substantially rectangular throughout and extending substantially from top to bottom and from side to side of said cell units, a plurality of valve metal anodes in hollow wave form in each said anode compartment, valve metal electrical connectors between the base of the waves of said anodes and the valve metal of said separating partition, said electrical connectors spacing the anodes from the valve metal of said partitions, an electrically conductive electrocatalytic coating on said anode waves, a plurality of metal cathodes in wave form in said cathode compartments, electrical connectors between the base of said cathode waves and the ferrous metal of said partitions, said electrical connectors spacing the cathodes from the ferrous metal of said partitions, said anodes and cathodes extending substantially vertically in said compartments substantially from the top to the bottom and from side to side of said compartments, said anodes and cathodes being nested together to provide a substantially uniform spacing between the anode and cathode surfaces, a lining on the side walls of said anode compartments resistant to the electrolyte and electrolysis conditions, means to feed an electrolyte to said cell, means to pass an electrolysis current through the electrolyte between said anode and cathode surfaces, means to discharge anodic gases and cathodic gases from said cell, and means to discharge a catholyte liquor from the cathode compartments of said cell.

2. The cell of claim 1, in which diaphragms are provided between the anode and cathode waves.

3. The cell of claim 2, in which the anodes are made of titanium, and the lining of the anode compartment is made of titanium.

4. A bipolar electrolysis cell according to claim 2, in which the cathodes are diaphragm covered steel net and the anodes are open mesh titanium provided with a conductive electrocatalytic coating.

5. A bipolar electrolysis cell according to claim 4, in which the anodes are in the form of closed end fingers extending from the valve metal portion of said separating partitions, the cathodes are in the form of fingers extending from the ferrous metal portion of said separating partitions, the rectangular frame is titanium lined, the anode fingers and the cathode fingers nest together providing a uniform spacing therebetween and the valve metal of said separating partitions and the ferrous metal of said separating partitions are secured together back to back to provide a bipolar metallic electrical contact between one cell unit and another cell unit.

6. A bipolar cell according to claim 5, in which the titanium and the ferrous metal of said separating partitions are secured together by electric welding.

7. A bipolar electrolyzer according to claim 5, in which the titanium portion and the ferrous metal portion of said separating partitions are secured together by titanium bolts extending through the titanium portion into threaded holes in the ferrous metal portion of said separating partitions and the anode waves are connected to the titanium bolts to provide an electrical path between the bipolar cell units.

8. The cell of claim 7, in which the anode waves are connected to the titanium bolts which extend into the ferrous metal portion of the separating partitions by smaller titanium bolts which are screw threaded into a hole in the first-named titanium bolts.

9. A bipolar electrolyzer according to claim 5, in which the cathode compartments are surrounded by a rectangular-shaped steel pipe frame, said frame has a number of holes in its upper horizontal leg for the passage of gas into the horizontal leg and a gas discharge passage from said horizontal leg and one of the side legs of said frame has holes for the passage of catholyte liquor into said side leg and said side leg is connected to an adjustable catholyte outlet.

10. The cell of claim 1, in which the anodes are of open mesh construction and each cell unit is provided with a diaphragm and means are provided to regulate the level of the catholyte liquor in the cathode compartments.

11. A bipolar electrolyzer according to claim 1, in which a chlorine resistant container on the top of each cell unit receives produced chlorine gas from the cell units and feeds fresh brine into the cell units.

12. The cell of claim 1, in which the means to discharge catholyte liquor from the cathode compartment constitutes an adjustable tube to control the catholyte liquor level in said cell unit.

13. The cell of claim 1, in which the rectangular frame of each cell unit is provided with flanges matching with the flanges of the adjacent cell unit, gaskets are provided between said flanges and all the cell units are held together with said flanges in contact with said gaskets by tie rods insulated from their surrounding parts.

14. In a bipolar electrolysis cell, a positive end unit containing anodes and cathodes, a negative end unit containing anodes and cathodes and a plurality of intermediate units containing anodes and cathodes, all of said units being substantially rectangular and each of said units having an anode compartment and a cathode compartment, said anode compartments and cathode compartments being separated from the adjacent cell units by a continuous partition of ferrous metal on the cathode side and a valve metal on the anode side, a corrosion resistant lining in each of said anode compartments, said units being connected in series to pass an electrolysis current through all of said cell units, the anode being constructed of a valve metal in the form of open mesh hollow finger-like waves and the cathodes being constructed of ferrous metal in the form of hollow finger-like waves which are nested together, means to permit anodic gases rising through the electrolyte to escape from the electrolyte from both the front and back of the anodes and from the top of each cell unit, the cathodes of one cell unit being connected back to back to the anodes of the adjacent cell unit by a metal to metal contact between the valve metal anodes and the ferrous metal cathodes through said partitions.

15. The electrolysis cell of claim 14, in which the anodes are formed of titanium having an electrocatalytic conductive coating thereon, the cathodes are formed of ferrous metal, and a diaphragm is provided between the anodes and cathodes.

16. The cell of claim 15, in which the anodes are supported on the valve metal portion of said separating partitions, the said valve metal portion also forms part of the lining of the anode compartments, a titanium lining is provided on the side walls of the anode compartments, the cathodes are supported on the ferrous metal portion of said separating partitions and the two portions of said partitions are secured together back to back with a metal to metal contact.

17. The cell of claim 16, in which the space between the cathodes and the ferrous metal portion of the separating partitions forms a catholyte chamber and said space is surrounded by a rectangular pipe, said pipe having openings to receive and discharge catholyte gas and openings to receive and discharge catholyte liquor.

18. The electrolysis cell of claim 14, in which gas formed at the anodes rises through the electrolyte and is fed into a gas receiver at the top of each unit.

19. In an electrolysis cell, a first hollow rectangular metal box-like support, vertically mounted hollow metal anode fingers supported on and projecting from said first box-like support, means to introduce electrolyte into said first box-like support and said anode fingers, a second hollow rectangular metal box-like support, vertically mounted hollow cathode fingers supported on and projecting from said second box-like support, means to discharge spent electrolyte from said second box-like support, the said first and second box-like supports being secured together, back to back, in electronically conductive contact.

20. The cell of claim 19, in which the first hollow box-like support and the anode fingers supported thereby are made of titanium, the second hollow box-like support and the cathode fingers supported thereby are made of steel and each pair of anode and cathode fingers is enclosed within a hollow box-like enclosure forming the side walls of the cell.

21. The cell of claim 20, in which the first hollow box-like support has a passage for the inlet of electrolyte into the cell and a passage for the outlet of anodic gases, and the second hollow box-like support has a passage for the outlet of cathodic gases and a passage for the outlet of catholyte liquor.

22. In a bipolar electrolysis cell, an intermediate cell element comprising a first hollow valve metal box-like support, hollow open mesh valve metal anode fingers supported on and projecting vertically from said first support, means to introduce electrolyte into said first box-like support and discharge anodic gases therefrom, a second hollow metal box-like support, hollow open mesh metal cathode fingers supported on and projecting vertically from said second support, means to discharge cathodic gases and spent electrolyte from said second box-like support, the said anode and cathode fingers communicating with the interior of their respective supports, the said first and second supports being electrically secured to each other, back to back, and a hollow rectangular box-like enclosure, for each pair of anode and cathode fingers, forming the side walls of each cell element.

* * * * *

UNITED STATES PATENT OFFICE
CERTIFICATE OF CORRECTION

Patent No. 3,930,980 Dated January 6, 1976

Inventor(s) Oronzio de Nora et al

It is certified that error appears in the above-identified patent and that said Letters Patent are hereby corrected as shown below:

Column 1, last line, "places", should be --spaces--

Column 2, line 45 "welding", should be --welded--

Column 5, line 11, after "to", insert --and spaced from-- line 22, before "used" insert --are--

The above are Patent Office errors. In addition, the following error was found:

Column 6, line 19, the matter in parentheses "(11 - 125)" should be --(11 - 12%) --.

Signed and Sealed this

Twelfth Day of October 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,930,980

DATED : Jan. 6, 1976

INVENTOR(S) : Oronzio deNora and Vittorio deNora

It is certified that error appears in the above-identified patent and that said Letters Patent are hereby corrected as shown below:

[30] Foreign Application Priority Data

April 23, 1970 Italy 23757-A/70

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*